US005807444A

United States Patent [19]

Paradis et al.

[11] Patent Number: 5,807,444

[45] Date of Patent: Sep. 15, 1998

[54] PROCESS FOR THE CONTINUOUS CASTING OF AN AUSTENITIC STAINLESS STEEL STRIP ONTO ONE OR BETWEEN TWO MOVING WALLS WITH DIMPLED SURFACES, AND CASTING PLANT FOR ITS IMPLEMENTATION

[75] Inventors: Philippe Paradis, Isbergues; Christian Marchionni, Rosselange; Manuel Bobadilla, Saulny; Jean-Michel Damasse, Isbergues, all of France

[73] Assignees: Usinor Sacilor, Puteaux, France; Thyssen Stahl Aktiengesellschaft, Duisburg, Germany

[21] Appl. No.: 818,283

[22] Filed: Mar. 17, 1997

[30] Foreign Application Priority Data

Mar. 22, 1996 [FR] France ..... 96 03545

[51] Int. Cl.[6] ..... C21D 1/04

[52] U.S. Cl. ..... 148/542; 164/481; 164/482; 164/428; 164/429

[58] Field of Search ..... 148/542; 164/479, 164/480, 481, 482, 428, 429, 431, 432, 433

[56] References Cited

U.S. PATENT DOCUMENTS

| | | | |
|---|---|---|---|
| 5,103,895 | 4/1992 | Furuya et al. | 164/475 |
| 5,160,382 | 11/1992 | Smith et al. | 148/327 |
| 5,227,251 | 7/1993 | Suichi et al. | 428/687 |

FOREIGN PATENT DOCUMENTS

| | | |
|---|---|---|
| 0164678 | 12/1985 | European Pat. Off. . |
| 0409645 | 1/1991 | European Pat. Off. . |
| 0481481 | 4/1992 | European Pat. Off. . |
| 0577833 | 1/1994 | European Pat. Off. . |
| 9513889 | 5/1995 | WIPO . |

*Primary Examiner*—John Sheehan

*Attorney, Agent, or Firm*—Sixbey Friedman Leedom & Ferguson; Thomas W. Cole

[57] ABSTRACT

The subject of the invention is a process for the continuous casting of an austenitic stainless steel strip directly from liquid metal of composition, expressed in percentages by weight: C≦0.08%, Si≦1%; Mn≦2%; P≦0.045%; S≦0.030%; Cr between 17.0 and 20.0%; Ni between 8.0 and 10.5% on a machine for casting onto one or between two moving walls whose external surface is provided with dimples and in which the region surrounding the meniscus is inerted with an inerting gas of controlled composition, wherein:

a $Cr_{equ}/Ni_{equ}$ ratio greater than 1.55 is conferred on said liquid metal, with:

$Cr_{equ}$=% Cr+1.37×% Mo+1.5×% Si+2×% Nb+3×% Ti and $Ni_{equ}$=% Ni+0.31×% Mn+22×% C+14.2×% N+% Cu;

one or more moving walls are used whose entire surface includes touching dimples having a diameter of between 100 and 1500 μm and a depth of between 20 and 150 μm;

and an inerting gas is used consisting, at least partially, of a gas which is soluble in steel.

The subject of the invention is also a casting plant for implementing this process.

7 Claims, No Drawings

PROCESS FOR THE CONTINUOUS CASTING OF AN AUSTENITIC STAINLESS STEEL STRIP ONTO ONE OR BETWEEN TWO MOVING WALLS WITH DIMPLED SURFACES, AND CASTING PLANT FOR ITS IMPLEMENTATION

FILED OF THE INVENTION

The invention relates to the continuous casting of metals. More specifically, it relates to plants for the continuous casting of metals such as stainless steel in the form of thin strip, by solidification of the liquid metal on a moving wall or between two moving walls. These moving walls may, in particular, consist of the side surfaces of one or two rolls, with a horizontal axis, which are vigorously cooled internally.

PRIOR ART

In recent years considerable progress has been made in the development of processes for casting thin steel strip directly from liquid metal. The process which currently seems to be the most likely to emerge rapidly into an industrial application is twin-roll casting in which the rolls are internally cooled, rotate about their horizontal axes in opposite directions and are arranged facing each other, the minimum distance between their surfaces being substantially equal to the desired thickness of the cast strip (for example a few mm). The casting space containing the liquid steel is defined by the side surfaces of the rolls, on which solidification of the strip is initiated, and by refractory side closure plates pressed against the ends of the rolls. Optionally, the rolls may be replaced by two cooled running belts. In order to cast products with an even smaller thickness, it has also been proposed to carry out solidification by depositing the liquid metal on the cooled surface of a single rotating roll.

Obtaining good surface quality of the strip immediately is an essential element in making the casting operation successful. This is because the major advantage of casting thin strip directly from liquid metal is the possibility it offers of eliminating or considerably reducing the extent of the operation of hot rolling the thick intermediate product cast normally. When steel is cast in thick formats, it is possible to eliminate surface defects by grinding, and in any case, the extensive amount of rolling means that defects are significantly reduced in size. In contrast, in thin-strip casting processes, it is imperative to obtain a surface containing few defects immediately on casting. In particular, the strip must be as free as possible of small surface cracks, called "microcracks", as these are damaging to the quality of the end-product after the cold rolling which is to give the strip its final thickness.

These microcracks generally have a depth of about 40 $\mu$m and an aperture less than or equal to 20 $\mu$m, and it should be pointed out that they are associated with an area where the metal is rich in elements which segregate during solidification, such as nickel and manganese. It is therefore clear that these defects are formed during solidification of the steel on the rolls. Their appearance is connected with the contraction of the metal as it solidifies, the extent of which depends on the solidification path, and therefore on the composition of the cast metal. The conditions of contact between the steel and the surface of the rolls are also extremely important in that they govern the heat transfer responsible for solidification. They are mainly controlled by the roughness of the surface of the rolls, and also by the nature of the gas present during solidification in the etched parts in this surface in the case where it is not perfectly smooth. This is because this gas forms a "blanket" between the metal and the roll, and its effect on heat transfer depends on its nature and on how much of it is present. These two parameters are, in particular, governed by the mold-inerting device which is used to protect the liquid steel from atmospheric oxidation, especially in the region where the surface of the metal comes into contact with the roll, called the "meniscus". In general, the heat transfer is more intense when an inerting gas having a significant solubility in the liquid steel, such as nitrogen, is used than when an inerting gas which is insoluble in the liquid steel, such as argon, is used.

Document EP 0309247 proposes imparting roughness to the surface of the rolls in the form of "dimples", that is to say etched hollows with circular or oval apertures having a diameter of about 0.1 to 1.2 mm and a depth of 5 to 100 $\mu$m. Document EP 0409645 also concerns the nature of the inerting gas, and proposes combining the use of dimples and a mixture of gas which is soluble (nitrogen, hydrogen, $CO_2$ or ammonia) and gas which is insoluble (argon or helium) in the liquid metal. An inerting gas which is too soluble in the metal runs the risk of not preventing the metal from penetrating right into the bottom of the dimples: in this case, rapid solidification occurs, generating microcracks (just as if the casting surface were strictly smooth) which, additionally, leaves bumps on the surface of the strip constituting the "negative" impression of the dimples. Conversely, a gas which is completely insoluble runs the risk of expanding excessively and imprinting hollows in the surface of the strip. In other documents, it is proposed to produce these dimples by laser machining (EP 0577833) or by shot peening (JP 6134553 and JP 6328204). In all the documents just mentioned, the dimples are non-touching, being separated from each other by areas which are smooth or very slightly rough.

It has also been proposed (document EP 0396862) that the rolls should have circumferential grooves, set from 50 $\mu$m to 3 mm apart, which are from 10 $\mu$m to 1 mm in width and from 30 to 500 $\mu$m in depth.

Another document (WO 95/13889) proposes producing rolls having, on their surface, circumferential peaks and grooves from 10 to 60 $\mu$m in depth and set from 100 to 200 $\mu$m apart. This form of etching corresponds to a requirement concerning the composition of the metal, which is an austenitic stainless steel, for example of SUS 304 type, in which the $Cr_{equ}/Ni_{equ}$ ratio must be less than 1.6, and preferably even less than 1.55. The latter requirement is tantamount to saying that the solidification of the metal must take place in the primary austenite phase. If the $Cr_{equ}/Ni_{equ}$ ratio is greater than these values, the strip has depressions in the form of "crocodile skin", which may degenerate into microcracks.

However, experience shows that with these types of austenitic stainless steels the strip is highly sensitive to hot cracking. There is then the risk of causing the formation of large longitudinal cracks which constitute a problem at least as serious as that posed by the microcracks which it was desired to avoid. In order to remedy this, it is necessary drastically to reduce the quantities of embrittling residual elements present in the metal, such as sulfur and phosphorus. This leads to particular requirements regarding the choice of raw materials and/or the mode of smelting the liquid steel which, inevitably, increase the manufacturing cost of the products.

What is more, the methods just mentioned are not completely satisfactory in that, in many cases, the formation of microcracks on the product is still observed, even if it is a appreciably reduced compared to cases in which the steel is cast onto smooth rolls or rolls having an uncontrolled roughness.

SUMMARY OF THE INVENTION

The aim of the invention is to provide steel-makers with a method enabling them to cast austenitic stainless steels, for example (but not exclusively) those of SUS 304 type, in the form of thin strip having a thickness of a few mm, having as few microcracks and longitudinal cracks as possible, but without also having to work with a liquid metal having a drastically low residual-element content.

The subject of the invention is a process for the continuous casting of an austenitic stainless steel strip directly from liquid metal of composition, expressed in percentages by weight: C≦0.08%, Si≦1%; Mn≦2%; P≦0.045%; S≦0.030%; Cr between 18.0 and 20.0%; Ni between 8.0 and 10.5%; on a machine for casting onto one or between two moving walls whose external surface is provided with dimples and in which the region surrounding the meniscus is inerted with an inerting gas of controlled composition, wherein:

a $Cr_{equ}/Ni_{equ}$ ratio greater than 1.55 is conferred on said liquid metal, with:

$Cr_{equ}$=% Cr+1.37×% Mo+1.5×% Si+2×% Nb+3×% Ti and $Ni_{equ}$=% Ni+0.31×% Mn+22×% C+14.2×% N+% Cu;

one or more walls are used whose entire surface includes touching dimples having a diameter of between 100 and 1500 μm and a depth of between 20 and 150 μm;

and an inerting gas is used consisting, at least partially, of a gas which is soluble in steel.

In a preferred embodiment, said moving walls consist of the external surfaces of two cooled rolls with horizontal axes, rotating in opposite directions.

The subject of the invention is also a casting plant for the implementation of this process.

As will have been understood, the objective pursued by the invention is achieved by marrying the requirements regarding the composition of the metal, the roughness of the casting surface or surfaces and the composition of the inerting gas.

DESCRIPTION OF THE PREFERRED EMBODIMENTS

As has been stated, a thin strip of a metal sensitive to hot cracking is highly likely to develop longitudinal cracks as it solidifies. In order to remedy this drawback, it is proposed, according to the invention, to bring about the solidification of the strip not entirely in the primary austenite phase, but in a phase which includes primary ferrite. The proportion of primary ferrite must, however, not be too great, so as to minimize the contractions which the metal undergoes as it solidifies and which are associated with the transition from ferrite to austenite. Under these conditions, in order to obtain this result, an austenitic stainless steel (for example those of SUS 304 type, according to the AISI standard) whose composition, expressed in percentages by weight, is: C≦0.08%; Si≦1%; Mn≦2%; P≦0.045%; S≦0.030%; Cr between 17.0 and 20.0%; Ni between 8.0 and 10.5%, must in addition satisfy the condition: $Cr_{equ}/Ni_{equ}>1.55$ and preferably $1.55<Cr_{equ}/Ni_{equ}<1.70$. When $Cr_{equ}/Ni_{equ}$ lies between 1.55 and 1.70, the variations in volume associated with the ferrite-austenite transformation, which starts before the end of the solidification, remain extremely small and are easily compensated for by additions of liquid metal. When $Cr_{equ}/Ni_{equ}$ is greater than 1.70, the contractions associated with the ferrite-austenite transformation start to increase and the reduction in microcracks becomes less significant.

The $Cr_{equ}/Ni_{equ}$ ratio is calculated from the Hammar and Swensson formulae, that is to say:

$Cr_{equ}$=% Cr+1.37×% Mo+1.5×% Si+2×% Nb+3×% Ti and $Ni_{equ}$=% Ni+0.31×% Mn+22×% C+14.2×% N+% Cu.

This particular composition of the steel, in order to be able fully to fulfill its role in limiting the surface defects, must go hand in hand with a configuration of the surface of the casting rolls which guarantees excellent heat-transfer uniformity over all of said surface. From this point of view, the configurations normally used in the prior art, in which the casting surfaces are conditioned so as to exhibit etched regions (grooves or dimples) separated from each other by areas which are smooth or very slightly rough, are not suitable. This is because they have, especially because of there being no possibility of the gas passing from one hollowed region to another, an abrupt alternation of relatively wide portions where the metal is directly in contact with the cooled roll and of equally wide portions where the metal is in contact with a gas blanket which moderates the cooling conditions. This alternation is prejudicial to good uniformity in the cooling of the strip and becomes a major drawback when a metal is cast which is likely to undergo a ferrite-austenite transformation as it solidifies.

Under these conditions, the impression of touching dimples on the surface of the rolls, which therefore leave little place for direct contact between the metal and the roll and allow the inerting gas to pass from one dimple to another, makes it possible to achieve the desired cooling uniformity. The roughness peaks serve as sites of solidification initiation, while the hollowed parts constitute "contraction joints" for the metal during solidification, and allow better distribution of the stresses than if the surface of the rolls had smooth or slightly rough plateaus between the dimples. Of course, cooling uniformity would also be achieved if rolls were used whose surfaces were strictly smooth. However, the cooling would then be too sudden and there would no longer be any benefit from the presence of contraction joints which make it possible to "damp" the ferrite-austenite transformation. This would generate large numbers of cracks. Moreover, one would be deprived of the possibility of modulating the intensity of the heat transfer by varying the composition and the flow rate of the inerting gas, which makes it possible, for example, to adjust the crown of the rolls during casting (see French Patent Application FR 2 732 627).

Moreover, the use of dimples rather than grooves, as in WO 95/13889, gives solidification which is more uniform over the width of the product, because of the random character of the surface structure of the roll.

In order to obtain the desired result, the touching dimples must have a diameter of from 100 to 1500 μm if they have an at least approximately circular shape. It goes without saying that they can also have a shape which is more or less roughly elliptical. In this case, their dimensions must give them a surface area substantially equivalent to that which circular dimples of the type mentioned previously would have. Their depth would be between 20 and 150 μm.

The dimples may be imprinted on the rolls by the usual known means: laser machining, photo-etching or shot peening. In the latter case especially, it goes without saying that the method used to obtain dimples of the desired size must take into account the mechanical properties of the nickel layer which usually covers the surface of the copper sleeve of the roll.

These dimple sizes must be matched to a composition of the inerting gas which is suited to them, at least in the meniscus region where the surrounding gas is trapped in the dimples between the surface of the roll and the meniscus. It is not possible, for example, to use pure argon, which is insoluble in steel, as it would form too thick a "blanket" which would make the contact between the steel and the roll too uneven. There would thus be too great and too sudden a temperature difference between the points of contact and the points of non-contact between the metal shell and the roll. This would slow down the solidification, and therefore the consolidation of the metal shell, too much and would thus encourage the formation of cracks. Conversely, the use of a pure soluble gas such as nitrogen runs the risk, in the case in which the dimples have a diameter lying at the top end of the range defined above and a shallow depth, of not being suitable either, since it could not prevent the steel from penetrating deeply into the dimples and from thus having too great an area of contact with the roll. The problems which it was desired to avoid would thus reappear, with the additional risk of forming bumps on the strip which would be the "negative" replica of the roughness of the rolls. It would therefore be necessary, by modeling and/or experiment, to determine which compositions of inerting gas present in the region of the meniscus are best suited to given dimples and to given metal compositions. Most generally, an inerting gas consisting of nitrogen (50–100%) and argon (0–50%) will be used. Excellent results are obtained with such an inerting gas, used in conjunction with touching dimples from 700 to 1500 $\mu$m in diameter and from 80 to 120 $\mu$m in depth, for casting a stainless steel of SUS 304 type having a $Cr_{equ}/Ni_{equ}$ ratio of between 1.55 and 1.70.

It is also necessary for the continuous casting machine to be equipped with an inerting device enabling the composition of the atmosphere in the meniscus region to be well controlled. For this purpose, the device described in French Patent Application FR 2 727 338 is satisfactory, but any other equivalent device may be used.

In order to obtain an even better surface quality of the end-product, provision may also be made to carry out, in line and just after casting, hot rolling at a temperature of between 800° and 1200° C., with a reduction ratio greater than or equal to 5%. This makes it possible to reduce the roughness of the as-cast strip and thus to impart a beautiful surface appearance to the cold-rolled end-product.

By way of example, Table 1 illustrates the effect of the $Cr_{equ}/Ni_{equ}$ ratio of the steel on the number of microcracks per $dm^2$ measured on a strip cast between two rolls. The results were obtained for two average dimple diameters (600 and 1000 $\mu$m) and for an inerting gas composed of 90% of nitrogen and 10% of argon. The compositions of the steels corresponding to the various tests are given in Table 2: these are austenitic stainless steels of SUS 304 type, the residual-element contents of which are not especially low.

TABLE 1 effect of the $Cr_{equ}/Ni_{equ}$ ratio on the number of microcracks per $dm^2$.

| $Cr_{equ}/Ni_{equ}$ | Number of microcracks per $dm^2$, 600 $\mu$m average dimple diameter | Number of microcracks per $dm^2$, 1000 $\mu$m average dimple diameter |
|---|---|---|
| 1.40 (reference) | 20 | 0 |
| 1.56 | 40 | 0 |
| 1.61 | 80 | 0 |
| 1.63 | 120 | 0 |
| 1.66 | 200 | 0 |
| 1.69 | 300 | 20 |
| 1.72 | 420 | 60 |
| 1.75 | 580 | 130 |
| 1.78 | 760 | 250 |
| 1.80 | 960 | 320 |
| 1.84 | | 570 |

TABLE 2 composition of the steels used in the tests in Table 1.

| % C | % Mn | % P | % S | % Si | % Ni | % Cr | % Cu | % Mo | % Nb | % Ti | % N | % $Cr_{eq}$ | % $Ni_{eq}$ | % $Cr_{eq}$/% $Ni_{eq}$ |
|---|---|---|---|---|---|---|---|---|---|---|---|---|---|---|
| 0.056 | 1.57 | 0.020 | 0.003 | 0.238 | 10.47 | 18.04 | 0.244 | 0.058 | 0.003 | 0.003 | 0.0523 | 18.49 | 13.18 | 1.40 |
| 0.021 | 1.52 | 0.020 | 0.002 | 0.453 | 10.40 | 18.13 | 0.035 | 0.062 | 0.003 | 0.003 | 0.0530 | 18.91 | 12.12 | 1.56 |
| 0.018 | 1.58 | 0.022 | 0.002 | 0.524 | 10.18 | 18.07 | 0.035 | 0.027 | 0.004 | 0.003 | 0.0441 | 18.91 | 11.73 | 1.61 |
| 0.054 | 1.42 | 0.021 | 0.002 | 0.255 | 9.04 | 18.03 | 0.161 | 0.188 | 0.001 | 0.003 | 0.0451 | 18.68 | 11.46 | 1.63 |
| 0.054 | 1.49 | 0.023 | 0.005 | 0.260 | 9.07 | 18.30 | 0.079 | 0.233 | 0.004 | 0.001 | 0.0452 | 19.02 | 11.45 | 1.66 |
| 0.014 | 1.63 | 0.021 | 0.001 | 0.470 | 10.01 | 18.65 | 0.178 | 0.162 | 0.002 | 0.003 | 0.0421 | 19.59 | 11.69 | 1.69 |
| 0.016 | 1.55 | 0.020 | 0.001 | 0.502 | 10.02 | 18.78 | 0.027 | 0.108 | 0.002 | 0.003 | 0.0441 | 19.69 | 11.50 | 1.71 |
| 0.041 | 1.30 | 0.023 | 0.004 | 0.371 | 6.81 | 18.27 | 0.107 | 0.162 | 0.008 | 0.002 | 0.0469 | 19.07 | 10.89 | 1.75 |
| 0.037 | 1.22 | 0.022 | 0.003 | 0.337 | 8.63 | 18.05 | 0.148 | 0.173 | 0.003 | 0.002 | 0.0413 | 18.80 | 10.56 | 1.76 |
| 0.041 | 1.14 | 0.017 | 0.004 | 0.347 | 8.56 | 18.39 | 0.019 | 0.019 | 0.002 | 0.002 | 0.0496 | 18.94 | 10.52 | 1.80 |
| 0.040 | 1.20 | 0.024 | 0.004 | 0.354 | 8.53 | 18.57 | 0.156 | 0.186 | 0.002 | 0.002 | 0.0407 | 19.37 | 10.52 | 1.84 |

As may be seen, for a 1000 $\mu$m average dimple diameter, a strip surface free or to all intents and purposes free of microcracks is obtained up to a $Cr_{equ}/Ni_{equ}$ ratio of 1.69 inclusive. It is normally considered that a microcrack density per $dm^2$ of less than or equal to 40 is a very good result. From this standpoint, the use of smaller diameter dimples (600 $\mu$m) gives less satisfactory results. However, it should be emphasized that the strips thus obtained are, for both types of dimples, free of longitudinal cracks, except just those for which there was a $Cr_{equ}/Ni_{equ}$ ratio of 1.40. The presence of such longitudinal cracks, visible to the naked eye, is a totally unacceptable defect since it remains on the rolled products, rendering them completely unsuitable for use. As has been stated, in order not to obtain such longitudinal cracks on a steel which could have a $Cr_{equ}/Ni_{equ}$ ratio of less than 1.55, it would be necessary to reduce its contents of embrittling elements (in particular sulfur and phosphorus), something which would appreciably increase the production cost. The combination of the casting conditions according to the invention enables this problem to be solved.

The effect of the dimple diameter on the formation of microcracks was also studied in more detail, and the results of this are summarized in Table 3. Two different grades, corresponding to $Cr_{equ}/Ni_{equ}$ ratios of 1.63 and 1.80 (see Table 2 for their detailed composition) were considered. The inerting gas was composed of 90% of nitrogen and 10% of argon.

TABLE 3 effect of the dimple diameter on the number of microcracks per $dm^2$

| Average dimple diameter ($\mu$m) | Number of microcracks per $dm^2$, $Cr_{equ}/Ni_{equ}$ = 1.63 | Number of microcracks per $dm^2$, $Cr_{equ}/Ni_{equ}$ = 1.80 |
|---|---|---|
| 100 | 400 | 2000 |
| 400 | 240 | 1350 |
| 600 | 120 | 960 |
| 800 | 30 | 580 |
| 1000 | 0 | 320 |
| 1200 | 20 | 300 |
| 1500 | 50 | 360 |

It may be seen in these examples that it is mainly for dimple diameters of about 700 to 1500 $\mu$m and a $Cr_{equ}/Ni_{equ}$ ratio of 1.63 that the best results, in terms of density of microcracks, is obtained. The absence of longitudinal cracks was noted on all the specimens examined.

With regard to the effect of the composition of the inerting gas (in this case, its character of being to a greater or lesser extent soluble in steel), the results of studying this are summarized in Table 4. The tests were carried out using rolls whose dimples had an average diameter of 1000 $\mu$m.

TABLE 4 effect of the composition of the inerting gas on the number of microcracks per $dm^2$

| % of argon/of nitrogen | Number of microcracks per $dm^2$, $Cr_{equ}/Ni_{equ}$ = 1.63 | Number of microcracks per $dm^2$, $Cr_{equ}/Ni_{equ}$ = 1.80 |
|---|---|---|
| 0/100 | 5 | 300 |
| 10/90 | 0 | 320 |
| 20/80 | 0 | 360 |
| 30/70 | 10 | 400 |
| 40/60 | 20 | 440 |
| 50/50 | 50 | 490 |
| 60/40 | 90 | |
| 80/20 | 200 | |
| 100 | 300 | |

It should be noted that the results are excellent mainly for argon contents of less than or equal to 50%, with a $Cr_{equ}/Ni_{equ}$ ratio of 1.63, the optimum being achieved for an argon/nitrogen ratio of from 10/90 to 20/80%. However, above 50% of argon it is found that the roughness of the roll is imprinted "as a negative" on the strip in an excessive manner and it is not recommended to work in this range of values.

Finally, with regard to the effect of in-line hot rolling, carried out just after casting, on the roughness Ra of the strip, Table 5 shows this effect on strip having a $Cr_{equ}/Ni_{equ}$ ratio of 1.63 cast on rolls with dimples having 1000 $\mu$m average diameter with an inerting gas composed of 90% of nitrogen and 10% of argon.

TABLE 5 effect of in-line hot rolling on the roughness of the strip

| Hot-rolling reduction ratio | Ra ($\mu$m) |
|---|---|
| 0% (no rolling) | 10.6 |
| 5% | 4.2 |
| 10% | 3.2 |
| 20% | 2.2 |
| 30% | 1.6 |
| 40% | 1.4 |
| 50% | 1.2 |

The roughness of the strip decreases when the reduction ratio of its thickness during hot rolling increases. The roughness values Ra usually encountered with no hot rolling on strip in the prior art are about 4.5 $\mu$m at least: a reduction ratio of 5% is therefore sufficient to obtain lower roughness values under the optimum conditions of the invention.

As has been stated, the invention may be applied to machines for casting, onto one or between two moving walls, thin metal products, such as a single-roll casting machine or a twin-belt casting machine. The main point, in respect of this plant, is that the composition of the steel, the casting surface or surfaces brought into contact with the liquid metal have the roughness characteristics which have just been described, and that the gaseous environment in the meniscus region may also be made to comply with the above teaching.

We claim:

1. A process for the continuous casting of an austenitic stainless steel strip directly from liquid metal of composition, expressed in percentages by weight: C≦0.08%, Si≦1%; Mn≦2%; P≦0.045%; S≦0.030%; Cr between 17.0 and 20.0%; Ni between 8.0 and 10.5%; on a machine for casting onto one or between two moving walls whose external surface is provided with dimples and in which the region surrounding the meniscus is inerted with an inerting gas of controlled composition, wherein:

a $Cr_{equ}/Ni_{equ}$ ratio greater than 1.55 is conferred on said liquid metal, with:

$Cr_{equ}$=% Cr+1.37×% Mo+1.5×% Si+2×% Nb+3×% Ti and $Ni_{equ}$=% Ni+0.31×% Mn+22×% C+14.2×% N+% Cu;

one or more walls are used whose entire surface includes dimples that mutually touch in order to conduct an inerting gas that uniformly cools a surface of said metal, said dimples having a diameter of between 100 and 1500 $\mu$m and a depth of between 20 and 150 $\mu$m;

and wherein said inerting gas comprises a gas which is soluble in steel.

2. The process as claimed in claim 1, wherein said $Cr_{equ}/Ni_{equ}$ ratio is between 1.55 and 1.70.

3. The process as claimed in claim 1, wherein said dimples have a diameter of between 700 and 1500 $\mu$m and a depth of between 80 and 120 $\mu$m.

4. The process as claimed in claim 1, wherein said inerting gas is a mixture containing 50–100% of nitrogen and 0–50% of argon.

5. The process as claimed in claim 1, wherein said strip is subjected, directly after it has been cast, to hot rolling at a temperature of 800° to 1200° C., with a reduction ratio greater than or equal to 5%.

6. The process claimed in claim 1, wherein said moving walls consist of the external surfaces of two cooled rolls with horizontal axes, rotating in opposite directions.

7. A process for the continuous casting of an austenitic stainless steel strip directly from liquid metal of composition, expressed in percentages by weight: C≦0.08%, Si≦1%; Mn≦2%; P≦0.045%; S≦0.030%; Cr between 17.0 and 20.0%; Ni between 8.0 and 10.5%; on a machine for casting onto one or between two moving walls whose external surface is provided with dimples and in which the region surrounding the meniscus is inerted with an inerting gas comprised at least in part of a gas which is soluble in steel, wherein:

a $Cr_{equ}/Ni_{equ}$ ratio greater than 1.55 is conferred on said liquid metal, with:

$Cr_{equ}$=% Cr+1.37×% Mo+1.5×% Si+2×% Nb+3×% Ti and $Ni_{equ}$=% Ni+0.31×% Mn+22×% C+14.2×% N+% Cu;

wherein said process comprises the steps of providing dimples on one or more of said moving walls that mutually touch such that an inerting gas is conducted between said dimples during a casting operation, said dimples having a diameter of between 100 and 1500 μm and a depth of between 20 and 150 μm, and casting said steel between said walls while conducting said gas through said mutually touching dimples in order to uniformly cool a surface of said metal to prevent microcracks from forming therein.

* * * * *